US006536167B2

(12) United States Patent
Glavan

(10) Patent No.: US 6,536,167 B2
(45) Date of Patent: Mar. 25, 2003

(54) STRUCTURAL ASSEMBLY

(76) Inventor: John Glavan, Suite 403-505 Lonsdale Avenue, North Vancouver, B.C. (CA), V7M 2G6

( * ) Notice: Subject to any disclaimer, the term of this patent is extended or adjusted under 35 U.S.C. 154(b) by 97 days.

(21) Appl. No.: 09/824,782

(22) Filed: Apr. 4, 2001

(65) Prior Publication Data

US 2002/0144469 A1 Oct. 10, 2002

(51) Int. Cl.[7] ..... E04B 7/00
(52) U.S. Cl. ..... 52/81.3; 52/81.2; 52/655.1
(58) Field of Search ..... 52/3, 5, 11, 12, 52/22, 23, 41, 42, 90.1, 90.2, 81.2, 81.3, 655.1

(56) References Cited

U.S. PATENT DOCUMENTS 3,018,858 A * 1/1962 Finlayson ..... 52/81.2
3,418,768 A * 12/1968 Cardan ..... 52/167.1
4,559,746 A * 12/1985 Ishler ..... 52/2.17
5,127,759 A * 7/1992 Orbom ..... 403/171
5,704,169 A * 1/1998 Richter ..... 52/81.2
6,134,849 A * 10/2000 Holler ..... 52/80.1
6,192,634 B1 * 2/2001 Lopez ..... 52/81.2
6,237,298 B1 * 5/2001 Castano ..... 52/655.1

* cited by examiner

*Primary Examiner*—Jeanette Chapman

(57) ABSTRACT

A structural assembly has elongate members extending at angles to one another from connector members and forming with the connector members a lattice structure having open spaces defined by the elongate members, with the connector members at corners of the open spaces. Tension members extending between the connector members have opposite end portions extending through the connector members to anchor members on the tension members. Adjustable fasteners retain the anchor members on the end portions of the tension members and the anchor members are distributed around the connector members, with each of the anchor members in a respective one of the angles in wedging relationship with a pair of the elongate members.

24 Claims, 17 Drawing Sheets

STRUCTURAL ASSEMBLY

BACKGROUND OF THE INVENTION

1. Field of the Invention

The present invention relates to a structural assembly and, more particularly, to an assembly of structural elements which is useful, for example, to support a roof, or as a platform or as a bridging structure.

2. Description of the Related Art

The prior art includes various space frame structures which are useful, for example, for use as roof support structures extending over relatively large areas. The prior art space frames have mostly been constructed of more or less rigid elongate members, usually in the form of tubing, which are connected to one another in triangular arrays.

It is, however, a disadvantage of such prior art structures that the components are themselves relatively heavy, which requires the heavy weight of these components to be supported by the structures themselves, in addition to any loads exerted on the structures. Also, the components of these prior art space frames are expensive, bulky to store and transport and, when assembled, form space frames which are relatively bulky and of large height. As the spans are increased, the heights are correspondingly increased.

A further disadvantage of some prior art space frame structures is that their components must be welded together and therefore cannot be readily disassembled for subsequent reassembly.

BRIEF SUMMARY OF THE INVENTION

According to the present invention, there is provided a structural assembly, comprising a plurality of elongate members and connector members between the elongate members. The elongate members extend at angles to one another from the connector members and form with the connector members a lattice structure having open spaces defined by the elongate members with the connector members at corners of the open spaces. Tension members extend between the connector members and have opposite end portions extending through the connector members to anchor members. Adjustable fasteners retain the anchor members on the end portions with the anchor members distributed around the connector members and with each of the anchor members in a respective one of the angles in wedging relationship with a pair of the arms.

In a preferred embodiment of the invention, the elongate members are I-beams and the connector members, the anchor members and the I-beams are made of aluminum, so that the components of the assembly are of very light weight and are compact for storage and transportation. The entire assembly can be of shallow vertical dimensions and, in addition, can be readily disassembled for reassembly in a different location and/or shape, or can be readily expanded, e.g to provide additional coverage of an underlying space.

BRIEF DESCRIPTION OF THE DRAWINGS

The present invention will be more readily understood from the following description of preferred embodiments thereof given, by way of example, with reference to the accompanying drawings, in which.

DESCRIPTION OF THE PREFERRED EMBODIMENTS

Figure 1:
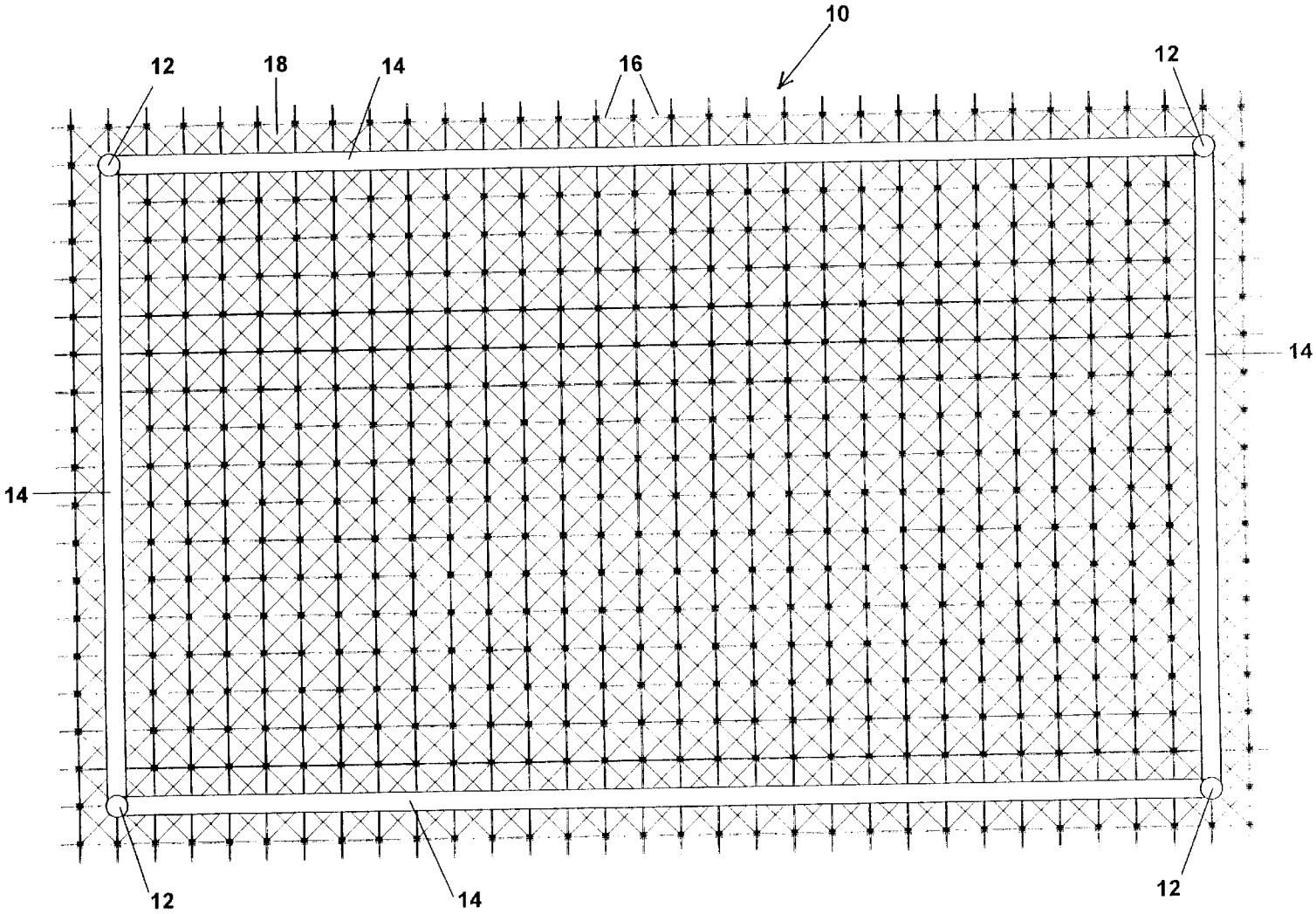
FIG. 1 shows an underneath plan view, from below, of a roof support structure formed by a structural assembly according to a first embodiment of the present invention.

In FIG. 1 of the drawings, there is shown a roof support structure in the form of a structural assembly which is supported on four underlying posts 12 and on beams 14 extending between the posts 12 to form a rectangular support structure extending around a marginal edge portion of the structural assembly.

The structural assembly comprises a lattice structure, indicated generally by reference numeral 10, formed by elongate components in the form of aluminum I-beams 16 and defining square spaces 18, the I-beams 16 extending between the corners of the square spaces 18.

Figure 2:
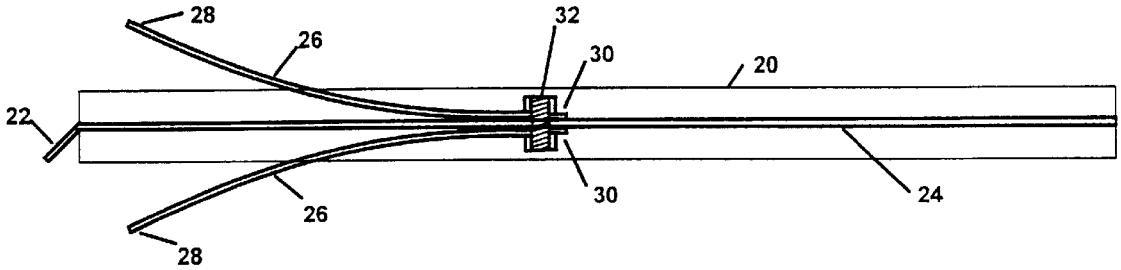
FIG. 2 shows a view taken in horizontal cross-section through an I-beam component of the structural assembly of FIG. 1, with a pair of attached leaf springs.

FIG. 2 shows a view in horizontal cross-section through one of the I-beams 16, which each have flanges 20 extending along a web 24 and, at one end, a projection in the form of an end flange 22 extending at an angle from the web 24.

A pair of leaf springs 26 is provided at opposite sides of the web 24 of the I-beam. In the present embodiment of the invention, the leaf springs 26 are made of fiber-reinforced plastic material, although other spring material, for example steel may alternatively be employed. Each of the leaf springs 26 is longitudinally curved between opposite ends 28 and 30 thereof when in a free state, as illustrated in FIG. 2. A fastener 32, comprising a bolt pin and a pair of nuts, extends through the end 30 of each of the leaf springs 26, and through the web 24 of the I-beam, to secure the leaf spring 26 opposite sides of to the I-beam 16 with the leaf spring 26 curving laterally outwardly of the I-beam 16 from the fastener 32.

Figure 3:
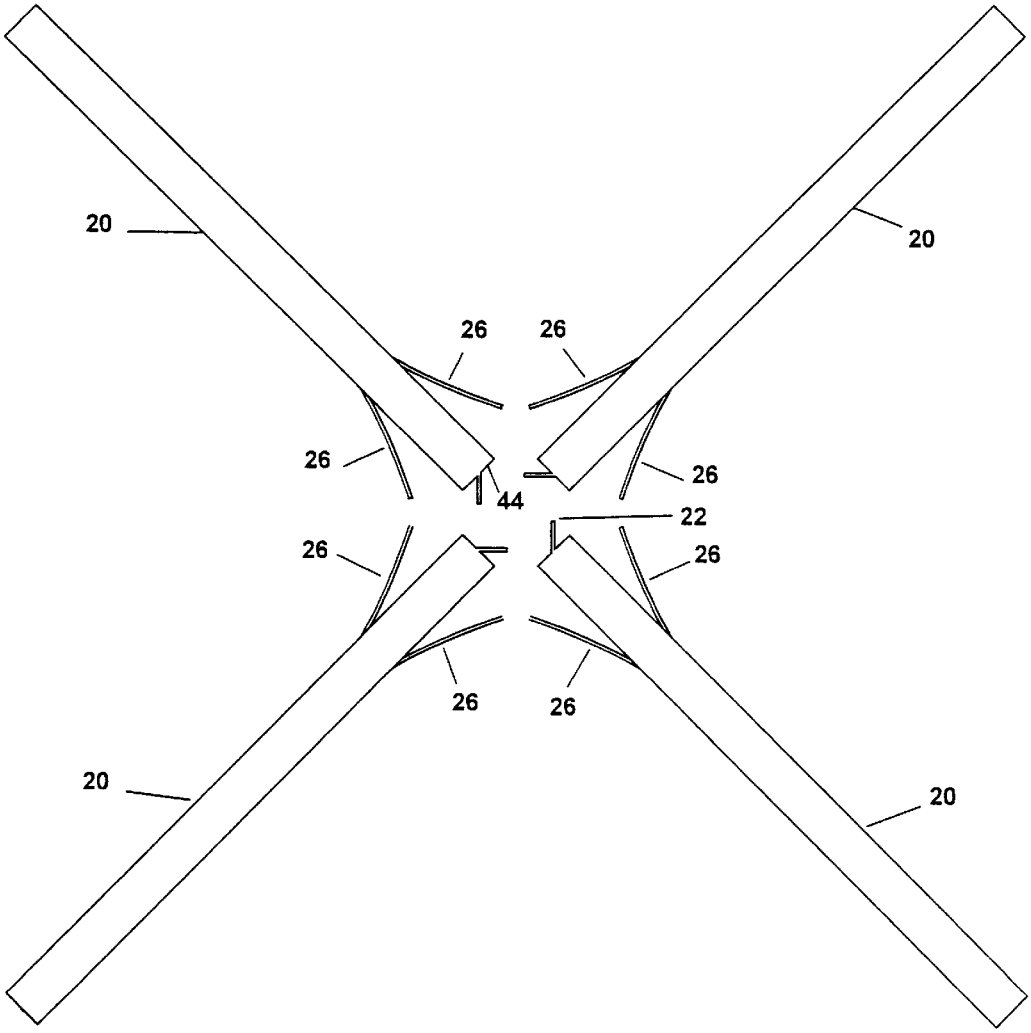
FIG. 3 shows a plan view of an array of four of the elongate components of FIG. 2 being assembled to form a cruciform component.
Figure 4:
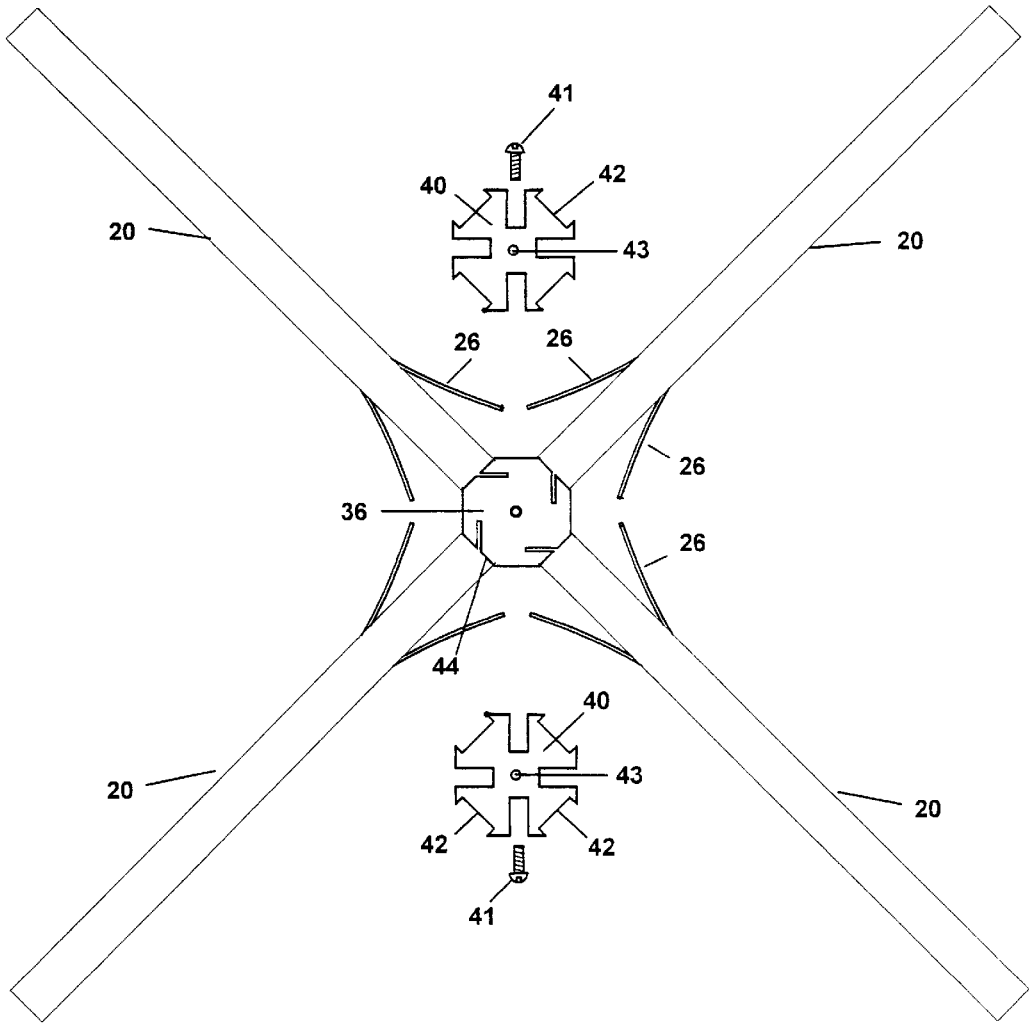
FIG. 4 shows a plan view of the array of FIG. 3 with a pair of metal plates being installed on a connector member to form a cruciform component.
Figure 7:
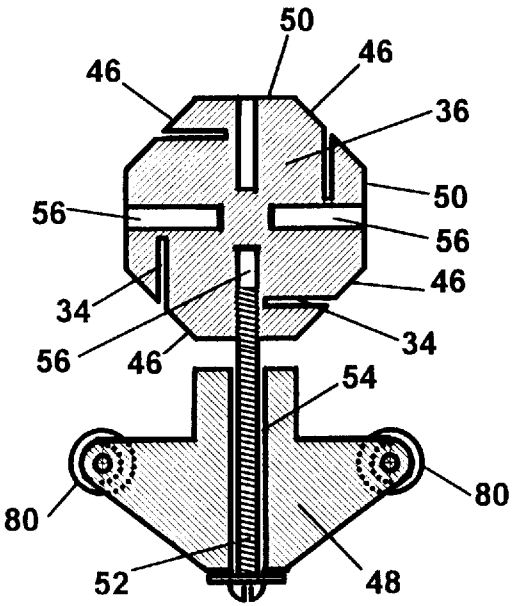
FIG. 7 shows a view taken in cross-section along the line 7—7 of FIG. 6.
Figure 6:
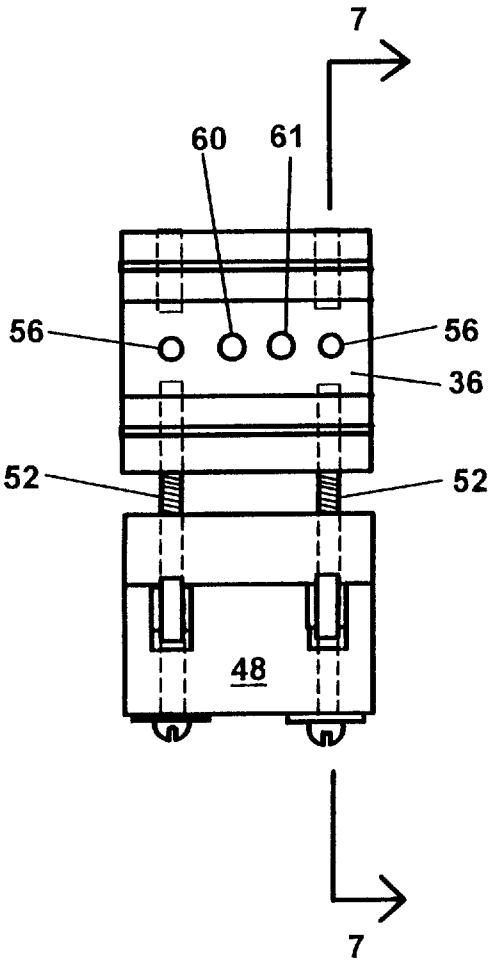
FIG. 6 shows a view in side-elevation of a connector member shown in FIG. 5 and an associated anchor member.

In a first step in the construction of the structural assembly 10, four of the I-beams 16 are arranged at right angles to one another, with their ends including the flanges 22 adjacent one another as shown in FIG. 3, and these flanges 22 are then interconnected by a hollow aluminum connector member 36, as shown in FIG. 4, by insertion of the flanges 22 into recesses formed by slots 34 (FIG. 7) in the connector member 36. In this way the four I-beams 16 and the member 36 are assembled to form a cruciform component indicated generally by reference numeral 38 in FIG. 5. Metal locking plates 40 (FIG. 4) are secured by a bolts 41 inserted through openings 43 into threaded engagement with the connector member 36 at the top and bottom of the connector member 36. The locking plates 42 are formed with cut-outs for receiving adjacent ends 44 of the I-beams 16 in order, thus, to assist in holding the I-beams 16 in position at right angles to one another. The locking plates 44 extend over and under the flanges 22 and thus retain the flanges 22 in the slots 34.

The connector member 36 is of octagonal horizontal cross-section and presents four faces 46 (FIG. 7) against which the ends 44 of the I-beams 16 abut.

Figure 5:
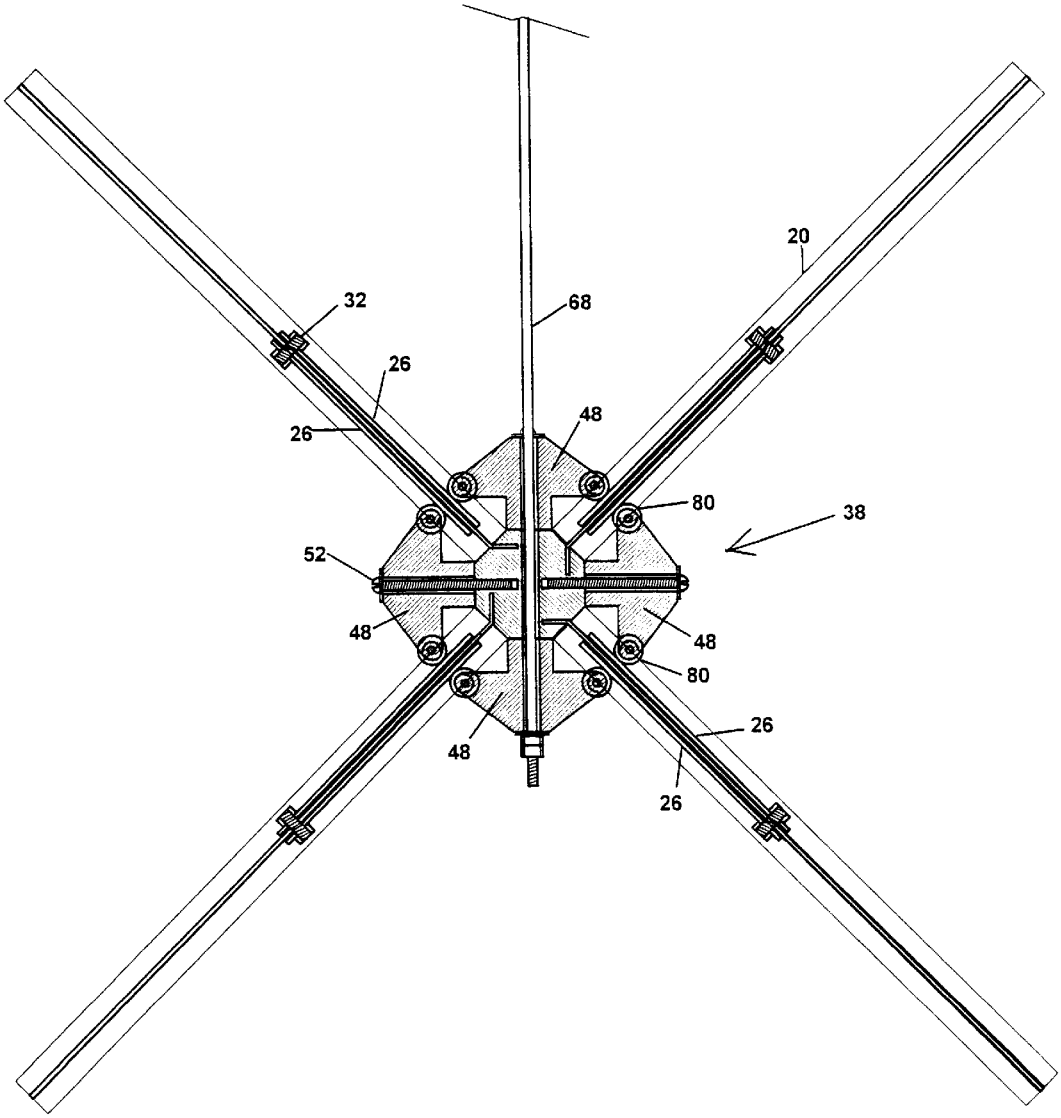
FIG. 5 shows a view, taken in horizontal cross-section, of the cruciform component of FIG. 4, together with further components of the structural assembly.

Four anchor members 48, which in the present embodiment are hollow aluminum components, abut four other faces 50 of the connector member 36, the anchor members 48 being distributed around the connector member 36 with each of the anchor members in a respective one of the angles between a respective pair of the arms, formed by the I-beams 16, of the cruciform component 38, as shown in FIG. 5.

The anchor members 48 are temporarily retained in position on the connector member 36 by means of screws 52 extending through screw openings 54 (FIG. 7) in the anchor members 48 and into threaded engagement in threaded openings 56 (FIGS. 7 and 8) in the connector member 36.

Figure 9:
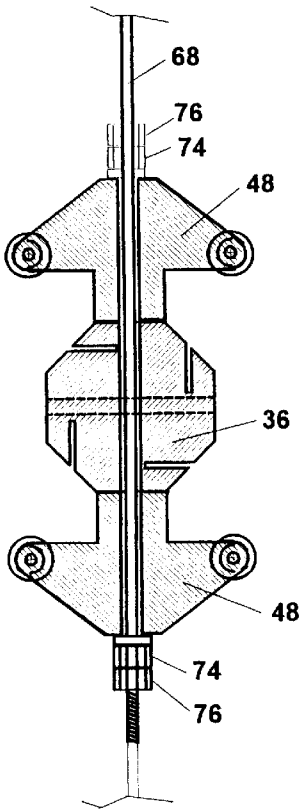
FIG. 9 shows a view taken in cross-section along the line 9—9 of FIG. 8.
Figure 8:
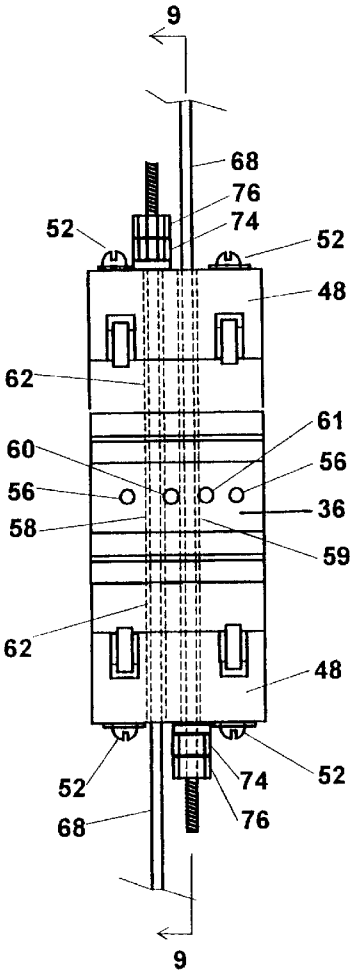
FIG. 8 shows a view corresponding to that of FIG. 6 but including additional components.

The connector member 36 is also formed with two pairs of through-openings 58, 59, and 60, 61, which extend at right angles to one another as viewed in FIGS. 8 and 9. The opening 58 is aligned with corresponding openings 62 extending through a pair of the anchor members 48, as shown in FIGS. 8 and 9, and the opening 60 in the connector member 36 is aligned with corresponding openings 61 extending through the other pair of the anchor members 48.

Figure 10:
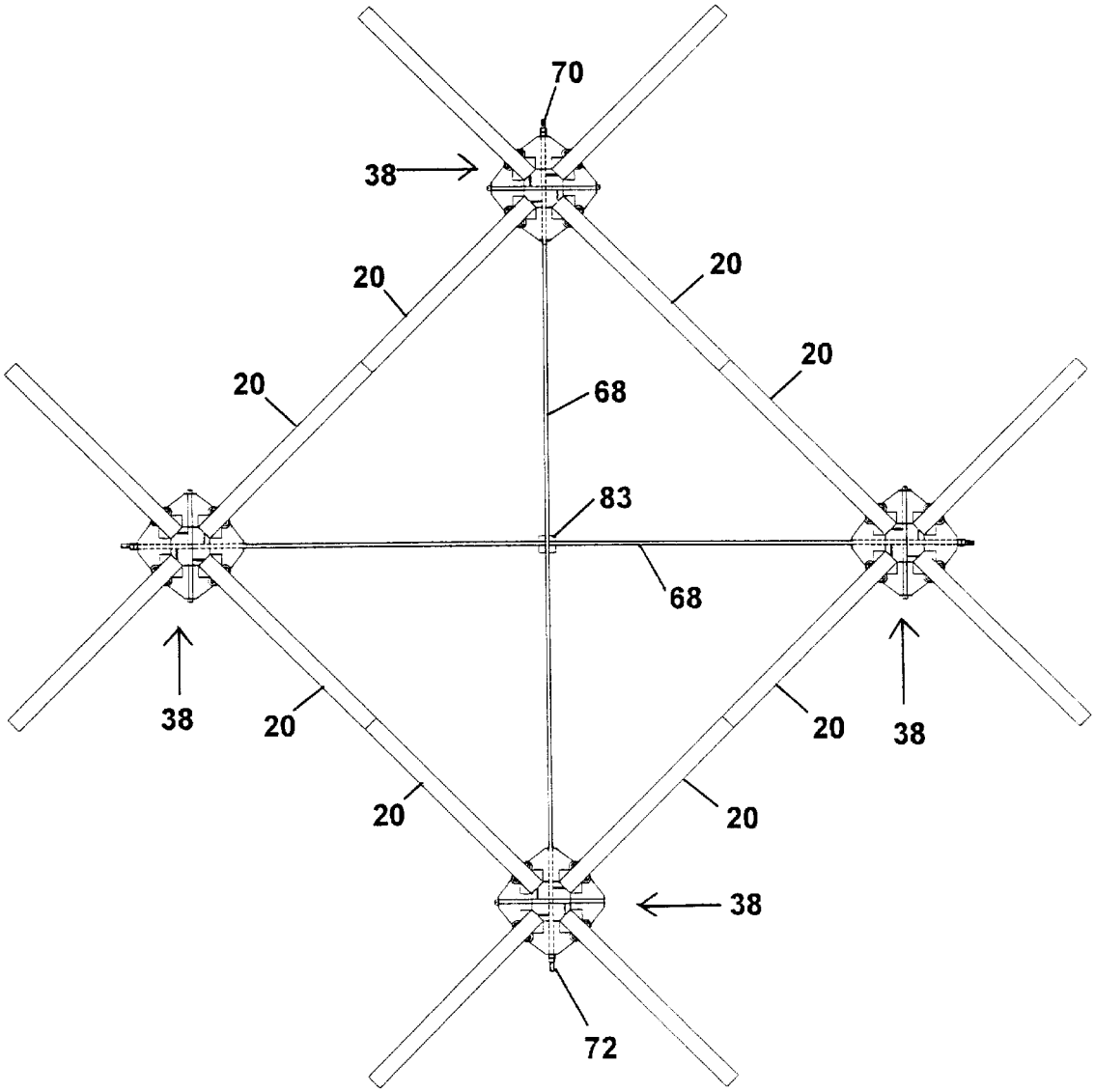
FIG. 10 shows a plan view of an interconnected array of four of the cruciform components.
Figure 10A:
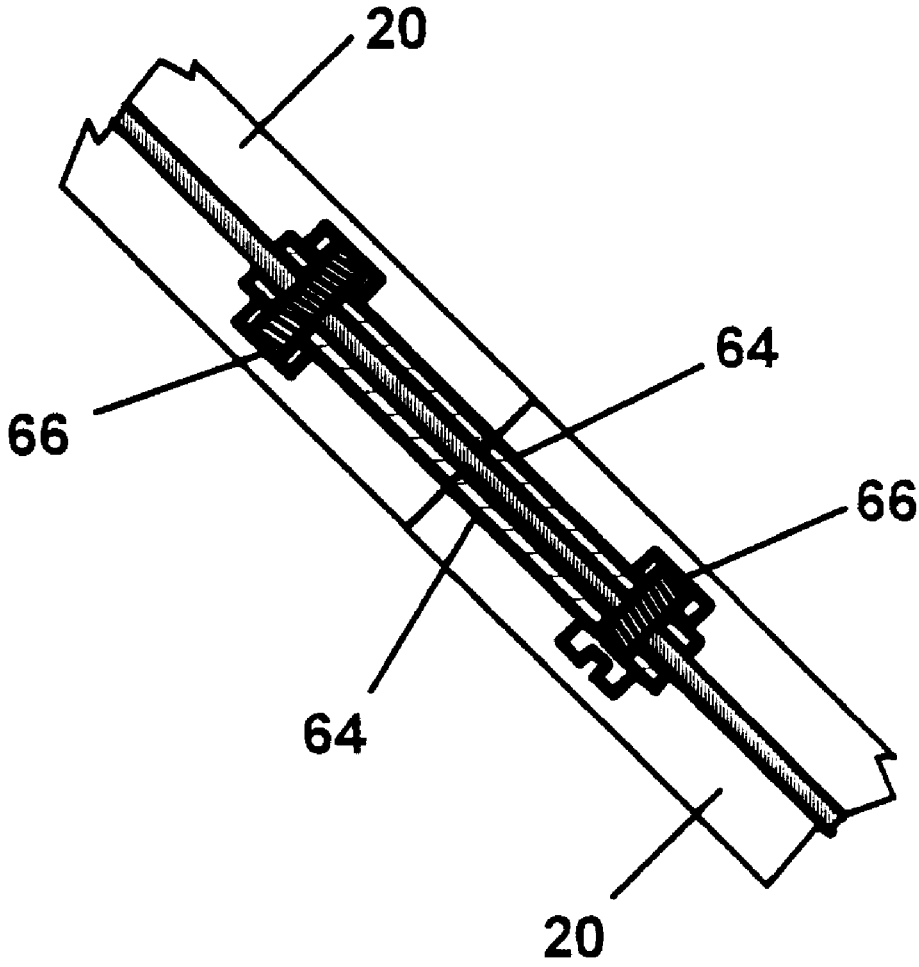
FIG. 10*a* shows a broken-away view in horizontal cross-section through a joint between a pair of I-beams shown in FIG. 10.

FIG. 10 shows four of the cruciform components 38 interconnected to form a sub-assembly. In this sub-assembly, the four cruciform components 38 co-operate to form one of the square spaces 18 between aligned and interconnected ones of the I-beams 16. These I-beams 16 are interconnected end-to-end by splice plates 64 (FIG. 10A) secured by fasteners 66 comprising nuts and bolts so as to interconnect the cruciform I-beams 16.

In addition, a pair of tension members in the form of tension rods 68 are shown in FIG. 10 and extend diagonally across the square space 18. Each of the tension rods 68 has opposite end portions 70 and 72 extending through one of the connector members 36 and through a respective pair of the anchor members 48. Beyond the anchor members 48, the end portions 70 and 72 of the tension rods 68, which are threaded, are provided with adjustable fasteners or retainers (FIG. 9) in the form of adjustment nuts 74 and lock nuts 76, which retain the anchor members 48 on the tension rods 68 in force-transmitting relationship with the I-beams 16.

Referring again to FIG. 5, it is recalled that the anchor members 48 are initially secured to their connector member 36 by the screws 52. When the tension rods 68 have been inserted through the connector members 36 and the anchor members 48, and the nuts 74 and 76 have been installed on the end portions 70 and 72 of the tension rods 68, thus retaining the anchor members 48 from sliding off the end portions 70 and 72 of the tension rod 68, the screws 52 can be removed.

The anchor members 48, as can be seen in FIG. 5, are provided on opposite sides of the anchor members 48 with rollers 80 which are in rolling engagement with the leaf springs 26 and which, when the tension rods 68 are inserted through the anchor members 48 and the connector members 36 and the nuts 74 and 76 are secured on the end portions 70 and 72 of the tension rods 68 against the anchor members 48, press against the leaf springs 26 so as to substantially flatten the formerly free ends 28 of the leaf springs 26 against the webs 24 of the I-beams 16. When the screws 52 are removed, these leaf springs 26 urge the anchor members 48 along the tension rods 68 in directions extending away from their associated connector member 36, the anchor members 48 being retained on their respective tension rods 68 by the nuts 74 and 76, which thus force each of the anchor members 48 into wedging relationship against the I-beams 16 between which that anchor member 48 is located.

To ensure that the anchor members 48 are each retained in engagement with their leaf springs 26, the screws 52 are not removed from the two anchor members 48 at opposite end portions 70 and 72 of each tension rod 68 until those anchor members 48 have been secured to respective end portions 70 and 72 by the nuts 74 and 76.

Figure 11:
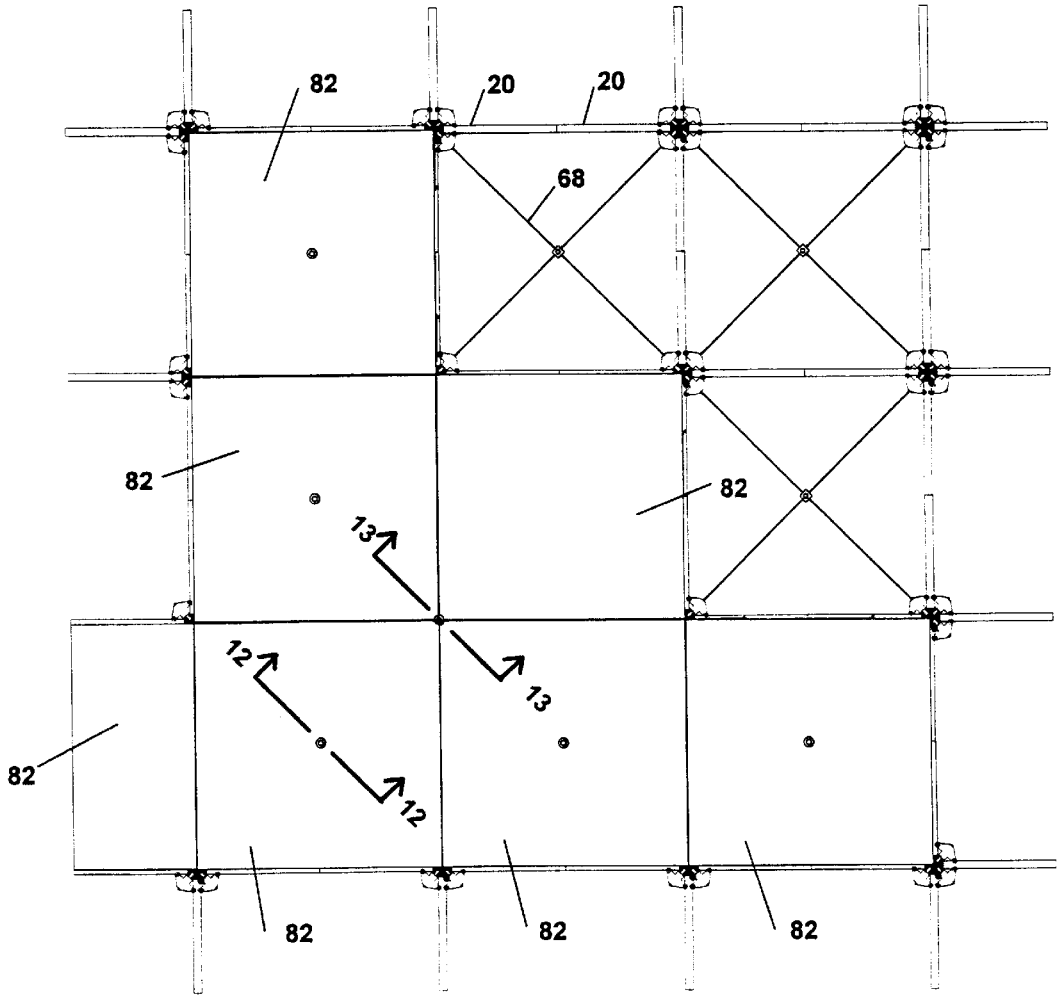
FIG. 11 shows a plan view of part of a roof under construction, incorporating a plurality of arrays such as that of FIG. 10.

FIG. 11 shows an assembly of a plurality of sixteen of the cruciform components 38, with their associated tension rods 68, forming a part of the complete structural assembly 10 of FIG. 1.

When the structural assembly 10 has been completed, the leaf springs 26 urge the two anchor members 48 on each tension rod 68 in opposite directions with equal and opposite tensile forces. Since the nuts 74 and 76 cannot move along the tension rods, the nuts 74 and 78 absorb the tensile forces in the tension rods 16 so as to substantially equalize these tensile forces, and therefore substantially no force is transmitted through the I-beams 16, even when a vertical load is exerted on the support structure. Loads exerted on the structural assembly are transmitted through the tension rods 68. This allows the I-beams 16 to be of light weight. Also, the forces exerted on the two leaf springs 26 at opposite sides of each I-beam 16 balance one another.

Following the completion of the lattice structure of the structural assembly 10, square, dome-shaped steel roof plates 82 are installed on the lattice structure, with each of the plates 82 located above and covering a respective one of the squares 18 of the lattice structure. As shown in FIG. 11, the installation of seven of the roof plates 82 has been completed.

Figure 12:
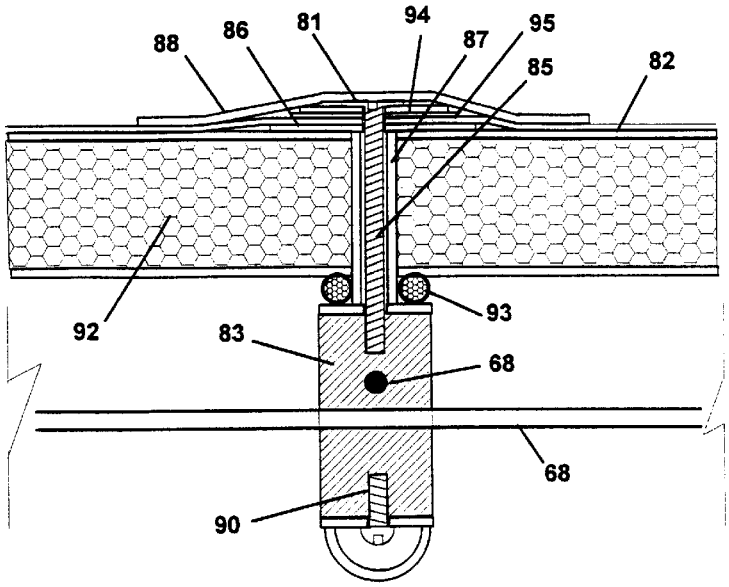
FIGS. 12 and 13 show views, taken in vertical cross-section along the lines 12—12 and 13—13, respectively, of FIG. 11, through roof plate retaining assemblies.

As shown in FIG. 12, which shows the two tension rods 68 in one of the squares 18 crossing one another, a hollow aluminum retaining member 83 is provided with openings receiving the tension rods 68 at right angles to one another through the retaining member 83. One of the roof plates 82 is secured to this retaining member 83 by means of a screw 85 in threaded engagement with the retaining member 83. The screw 85 has a screw head 81 and extends from the head 81 through washers 86 and a bushing 87 to the retaining member 83 and is covered by a sealing disk 88 above the roof plate 82.

A further screw 90 is in threaded engagement with the underside of the retaining member 83.

A panel of heat-insulating foam material 92 adhered to the underside of the roof plate 82 is provided between the roof plate 82 and the retaining member 83, with an elastomeric sealing ring 93 between the underside of the foam material 92 and the retaining member 83.

The washer 86 is interposed between the roof plate 82 and the foam material 92, and a further two washers 94 and 95 are interposed between the plate 82 and the screw head 81. Tightening of the screw 85 in the retaining member 83 securely clamps the roof plate 82 to the retaining member 83.

Figure 13:
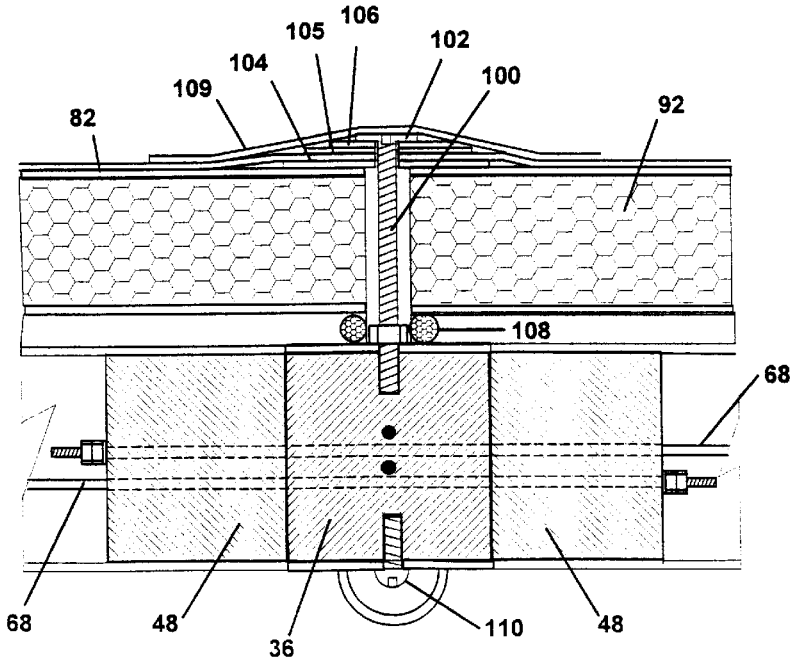

FIG. 13 shows a view taken in vertical cross-section through one of the connector members 36 along the line 13—13 of FIG. 11.

As shown in FIG. 13, a screw 100 having a screw head 102 extends between adjacent roof plates 82 and through the foam material 92 into threaded engagement with the connector member 36. This arrangement accommodates independent thermal and structural movements of the roof plates 82.

The screw 100 is provided with washers 104, 105 and 106, corresponding to the washers 86, 94 and 95, an elastomeric sealing ring 108 corresponding to the sealing ring 94 and a sealing disk 109 corresponding to the sealing disk 88.

Also, a screw 110 corresponding to the screw 90 is provided at the underside of the connector member 36.

In the embodiment of the invention illustrated in FIGS. 1 through 13, the structural assembly 10 forms a flat roof support structure. However, the present invention is not restricted to use as roof support structure, but may, for example, be used to form a floor or bridge structure.

Figure 14:
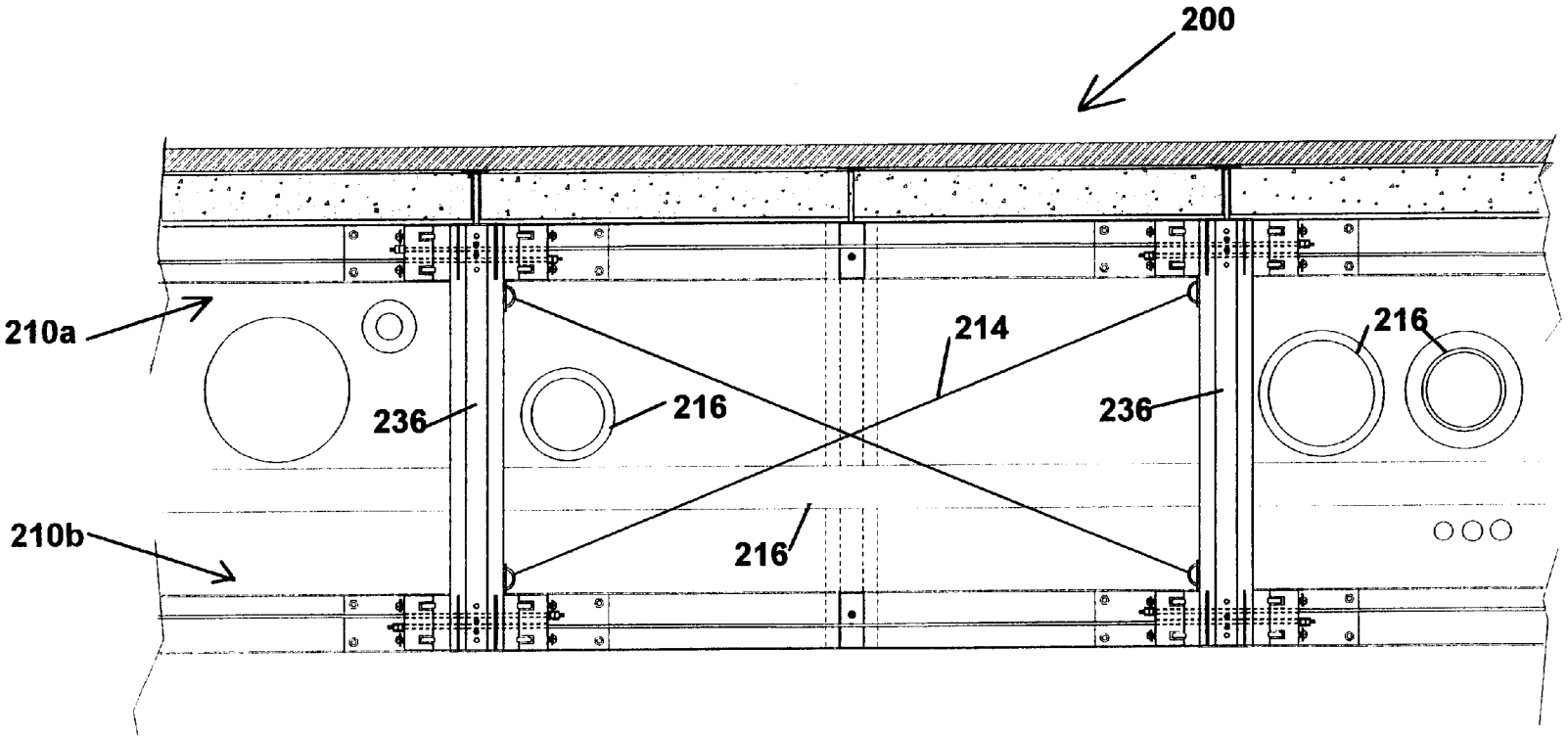
FIG. 14 shows a view taken in vertical cross-section through a double lattice structure according to a second embodiment of the present invention.

Thus, FIG. 14 shows a broken-away view, in vertical cross-section, through an embodiment of the invention forming part of a bridge structure indicated generally by reference numeral 200. In this embodiment, a pair of lattice structures indicated generally by reference numerals 210*a* and 210*b*, which are each similar to the lattice structure 10 shown in FIG. 1, are arranged one above the other, with vertical elongate connector members 236 extending between and into the two lattice structures 210*a* and 210*b*. Opposite ends of the connector members 236 serve the same functions in respective ones of the lattice structures 210*a* and 210*b* as the connector member 36 serves in the lattice structure 10 of FIG. 1. In addition, inclined tension rods 214 connected between the connector members 236 form braces between the two lattice structures 210*a* and 210*b*.

As can be seen in FIG. 14, the space between the lattice structures 210*a* and 210*b* can accommodate e.g. ducts 216 for water supply, electrical conduits, etc.

Apart from the fact that the connector members 236 are elongate and each form parts of the two lattice structures 210*a* and 210*b*, the latter are otherwise each similar to the above-described lattice structure 10 and are therefore not further described herein.

As will be apparent to those skilled in the art, the double lattice structure illustrated in FIG. 14 is not restricted to use as a bridge structure, but may, for example be employed to form a roof structure, or a platform or another support structure.

Figure 15:
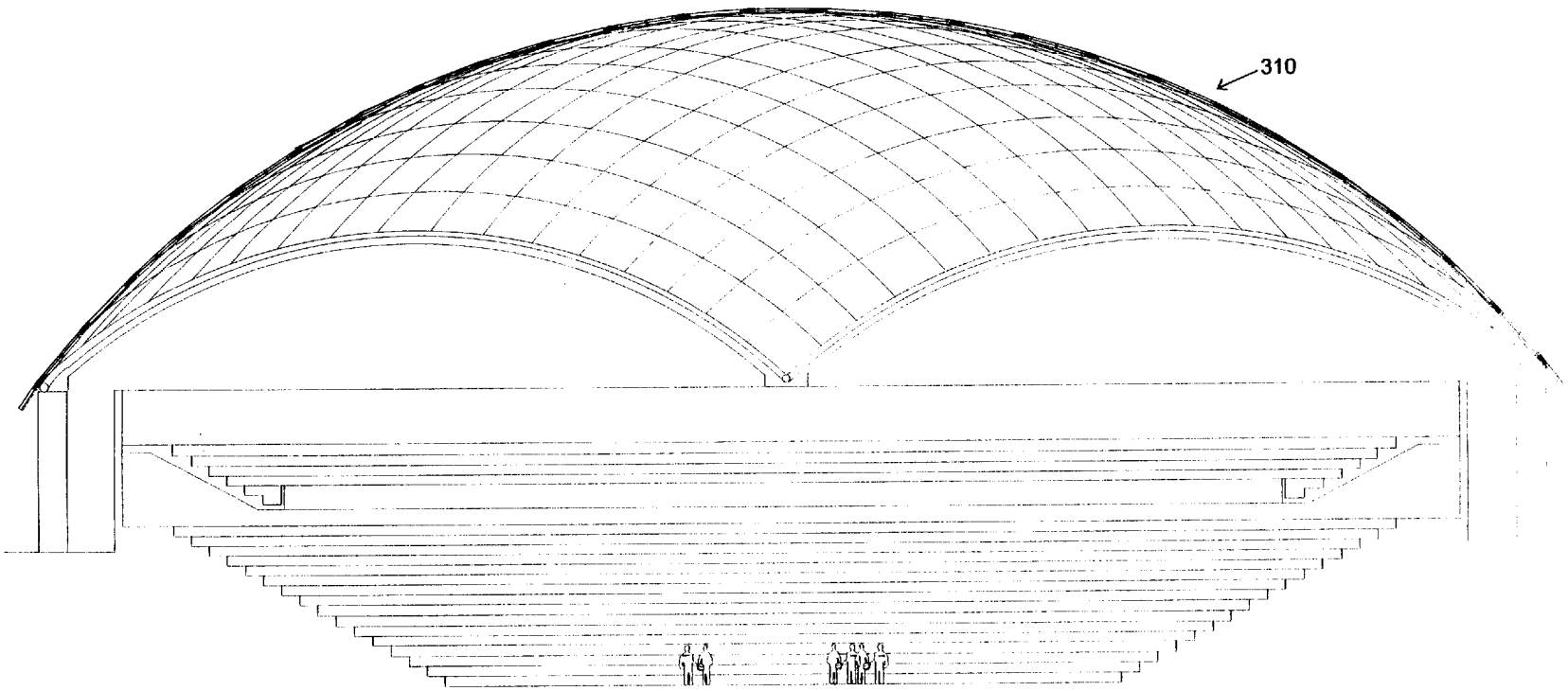
FIG. 15 shows a diagrammatic view, in vertical cross-section, through a building having a domed roof structure according to a third embodiment of the present invention.

While the lattice structure 10 illustrated in FIGS. 1 through 13 is generally flat, it is pointed out that the present invention can also be employed to form curved structures such as, for example, a dome-shaped roof lattice structure indicated generally by reference numeral 310 in FIG. 15 forming the roof of a stadium.

Figure 16:
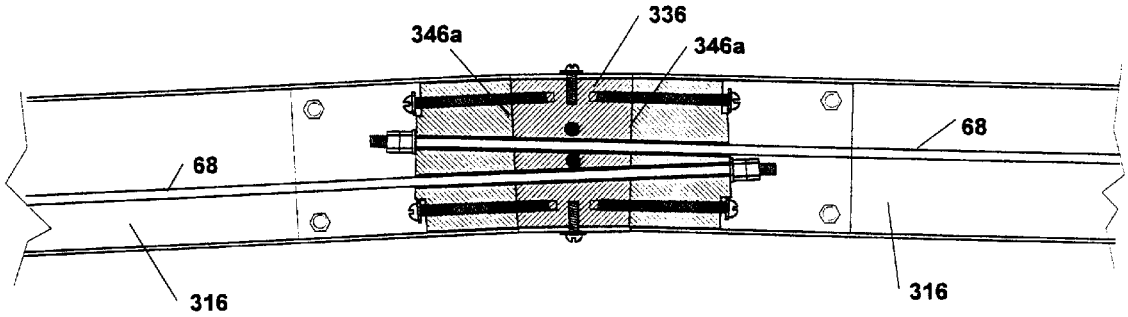
FIGS. 16 and 17 show broken-away views, in vertical cross-section, through components of the roof structure of FIG. 15.
Figure 17:
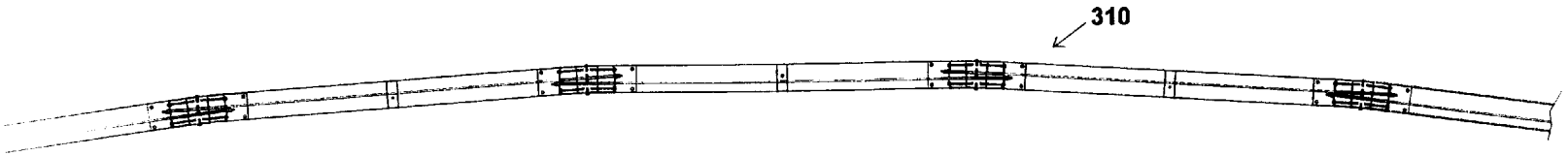

This dome shape can be achieved by modifying the faces of the connector members 36 so that they extend at an angle to one another, instead of being parallel to one another as in the embodiment of FIGS. 1 to 13. More particularly, FIG. 16 shows a modified connector member 336 having opposed downwardly convergent abutment faces 346*a* and 346*b*, the connector member 336 being provided between ends of a pair of I-beams 316 corresponding to the I-beams 16, with the ends of the I-beams 316 abutting the abutment surfaces 346*a* and 346*b* so that the I-beams 316 are inclined downwardly from the connector members. Also, the connector members 336 receive the tension rods 68 at corresponding angles. The lattice structure 310 is otherwise similar to the lattice structure 10.

The above-described embodiments of the invention comprise lattice structures formed with square interstices or spaces between the elongate members. However, the present invention may alternatively employ spaces of other, e.g. polygonal, shapes. For example, FIGS. 18 and 19 show components of a lattice structure having hexagonal spaces between elongate members.

Figure 18:
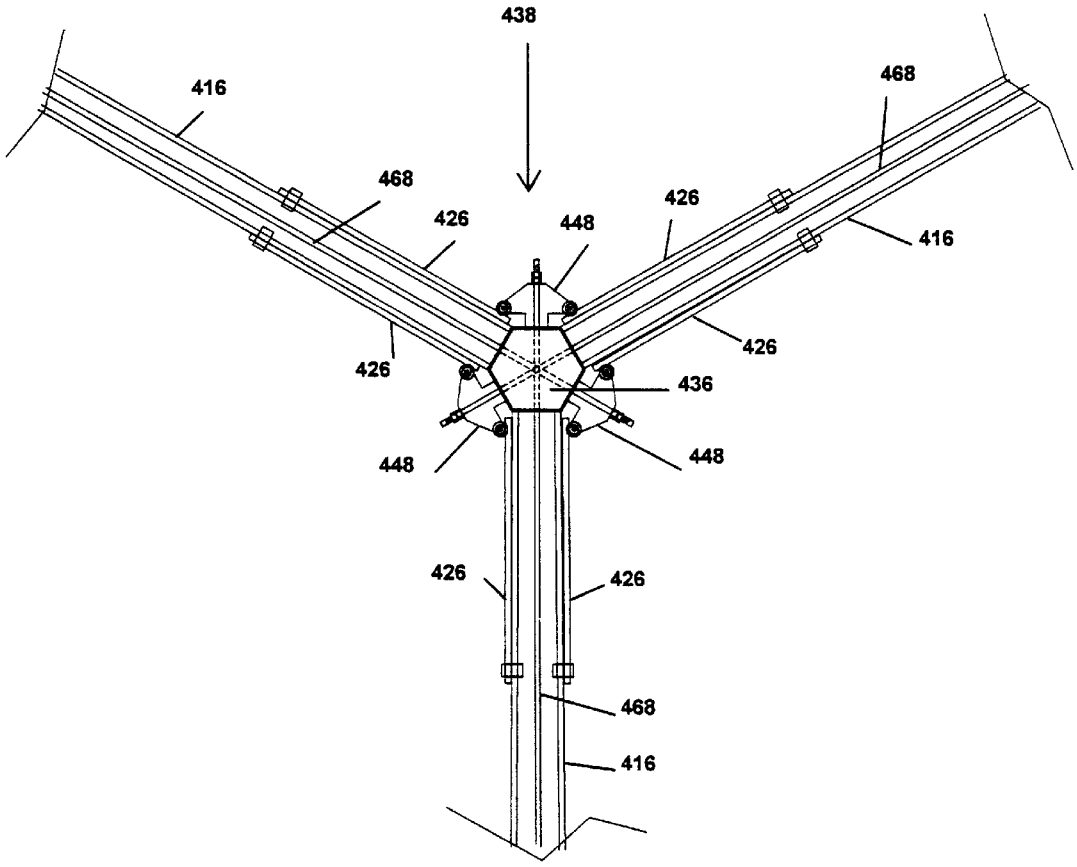
FIG. 18 shows a view in horizontal cross-section through a three-armed component formed by modified elongate members connected by a modified connector member.

More particularly, FIG. 18 shows, in horizontal cross-section, a three-armed component, indicated generally by reference numeral 438, which is formed by three elongate members in the form of channel members 416 of U-shaped cross-section connected at adjacent ends by a connector member 436 of hexagonal cross-section. The channel members 416 are each provided, on opposite sides, with a pair of leaf springs 426, corresponding to the leaf springs 26 on the I-beams 16, which are pressed against the channel members 416 by three anchor members 448 secured on the ends of three tension rods 468. This arrangement, except for the use of three elongate members, instead of four, connected by the connector member 436 and with the tension rods 468 extending axially along the interiors of the elongate members instead of across the spaces between the elongate members, is similar to the arrangement of the anchor members 48, tension rods 68, leaf springs 26 and connector members 36 described above with reference to FIGS. 2 through 10, and is therefore not described in greater detail.

Figure 19:
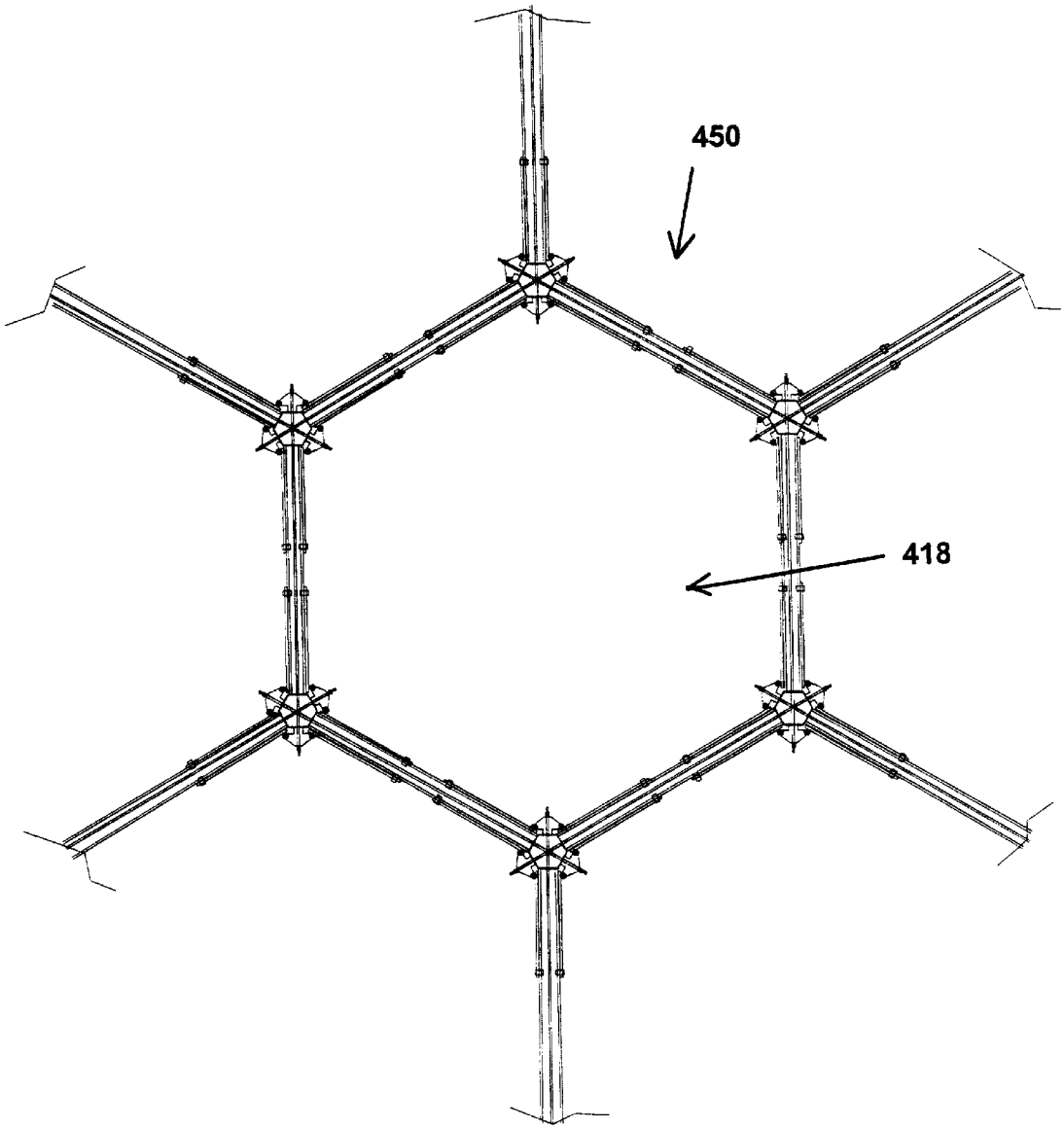
FIG. 19 shows a view taken in horizontal cross-section through an interconnected array of six of the three-armed components of FIG. 18 forming an hexagonal space between them.

FIG. 19 shows an array of six of the three-armed components 438 assembled to form an interconnected array, indicated generally by reference numeral 450, around a hexagonal space 418.

This array 450 can be interconnected with other similar arrays (not shown) to form a lattice structure which is somewhat similar to that shown in FIG. 1 except that it has hexagonal interstices, or spaces, similar to the space 418 instead of the square spaces 18 of FIG. 1.

As will be apparent to those skilled in the art, other modifications may be made within the scope of the invention. For example, the tension rods 68 may be replaced by other tension members, e.g. tension cables. Also, the rollers 80 of the anchor members 48 may be omitted, in which case they may be replaces by some other frictionless devices acting between the anchor members 48 and the leaf springs 26. The locking plates 42 may be replaced by simple octagonal plates, with central bolt holes.

I claim:

1. A structural assembly, comprising a plurality of elongate members and connector members between said elongate members;

said elongate members extending at angles to one another from said connector members and forming with said connector members a lattice structure having open spaces defined by said elongate members with said connector members at corners of said open spaces;

tension members extending between said connector members;

anchor members on said tension members;

said tension members having opposite end portions extending through said connector members to said anchor members; and adjustable fasteners retaining said anchor members on said end portions;

said anchor members being distributed around said connector members with each of said anchor members in a respective one of said angles in wedging relationship with a pair of said elongate members.

2. A structural assembly as claimed in claim 1, wherein four of said elongate members extend at right angles to one another from each of said connector members, said open spaces being square spaces and said tension members extending diagonally across said square spaces.

3. A structural assembly as claimed in claim 2, wherein said four elongate members are connected to said connector member to form a cruciform sub-assembly, and said cruciform sub-assembly is one of a plurality of similar sub-assemblies, said elongate members being connected together end-to-end to connect said sub-assemblies.

4. A structural assembly as claimed in claim 2, wherein said anchor members are slidable along said end portions of said tension members and wherein springs acting between said elongate members and said anchor members urge said anchor members against said adjustable retainers.

5. A structural assembly as claimed in claim 4, wherein said springs comprise leaf springs, said leaf springs each being longitudinally curved between opposite ends thereof when in a free state, said structural assembly including leaf spring fasteners securing one end of each of said leaf springs to a respective side of one of said elongate members.

6. A structural assembly as claimed in claim 5, wherein said anchor members include freely rotatable rollers in rolling contact with said leaf springs.

7. A structural assembly as claimed in claim 1, wherein said connector members have through openings freely slidably receiving therethrough said end portions of said tension members.

8. A structural assembly as claimed in claim 1, wherein said connector members and said elongate members have mutually interengaged projections and recesses.

9. A structural assembly as claimed in claim 8, wherein said projections comprise a flange on one end of each of said elongate members, each of said flanges being angled relative to the longitudinal axis of its respective elongate member, and said recesses comprise correspondingly angled slots in said connector members.

10. A structural assembly as claimed in claim 1, wherein three of said elongate members extend equiangularly with respect to one another from each of said connector members, said lattice structure having hexagonal spaces between said elongate members and said tension members extending along said elongate members between said connector members.

11. A structural assembly as claimed in claim 10, wherein said elongate members are channel members and said tension members are co-axial with said elongate members.

12. A structural assembly as claimed in claim 1, wherein saidn elongate members are c0-planar.

13. A structural assembly as claimed in claim 1, wherein said elongate members are each inclined downwardly from said connector members, whereby said lattice structure is dome-shaped.

14. A structural assembly as claimed in claim 13, wherein said connector members each have downwardly convergent abutment faces and said elongate embers abut said abutment faces.

15. A structural assembly, comprising:

a plurality of anchor members;

a plurality of tension members;

said anchor members having through openings and said tension members each having opposite end portions extending through said through openings of a respective pair of said anchor members;, with said anchor members being slidable along said end portions;

adjustable retainers retaining said anchor members on said end portions of said tension members;

a pair of cruciform components on each of said tension members between said anchor members;

said cruciform components each comprising a central portion and four arms extending radially outwardly from said central portion, and said arms forming right angles therebetween; and through openings extending through said central portions;

said arms of said cruciform components being connected to like arms of like cruciform components to form square spaces therebetween with said central portions at the corners of said square spaces;

said tension members extending diagonally across said square spaces, said end portions of said tension members extending through said openings in said central portions to said anchor members and one of said anchor members being located in each of said right angles.

16. A structural assembly as claimed in claim 15, including springs between said anchor members and said arms of said cruciform components.

17. A structural assembly as claimed in claim 16, wherein said springs comprise leaf springs each having first ends secured to respective sides of said arms and second ends, said first ends being located outwardly of said anchor members from said central portion and said second ends being located between said arms and said anchor members and being pressed towards said arms, by said anchor members.

18. A structural assembly as claimed in claim 16, wherein said anchor members have rollers in rolling contact with said leaf springs.

19. A structural assembly, comprising:

a lattice structure defining square space spaces;

said lattice structure comprising elongate components extending between corners of said square spaces;

anchor members located in the corners of said square spaces between said elongate components;

a pair of tension members extending diagonally across each of said square spaces and having opposite ends anchored by a pair of said anchor members in adjacent ones of said square spaces; and adjustable retainers in threaded engagement with said tension members and adjustably retaining said anchor members on said tension members in wedging relationship with said elongate components.

20. A structural assembly as claimed in claim 19, wherein the tension forces in said tension members balance one another and said elongate members are substantially free of longitudinal tension and compression forces.

21. A structural assembly, comprising a plurality of elongate members and connector members between said elongate members;

said elongate members extending at angles to one another from said connector members and forming with said connector members a lattice structure having open spaces defined by said elongate members with said connector members at corners of said open spaces;

tension members extending between said connector members;

anchor members on said tension members;

springs acting between said anchor members and said elongate members;

said tension members having opposite end portions extending through said connector members to said anchor members; and adjustable fasteners retaining said anchor members on said end portions;

said springs urging said anchor members against said adjustable fasteners and thereby tensioning said tension members;

said wedge members being distributed around said connector members with each of said wedge members in a respective one of said angles.

22. A structural assembly as claimed in claim 21, wherein said springs comprise leaf springs, and wherein a fastener secures one end of each of said leaf springs to a respective side of one of said elongate members, said leaf springs each having an opposite end urged against said respective side by one of said anchor members.

23. A structural assembly as claimed in claim 21, wherein four of said elongate members are each secured at one end thereof to one of said connector members at right angles to one another to form a cruciform sub-assembly and said elongate members are connected in end-to-end relationship at opposite ends thereof to interconnect a plurality of said cruciform subassemblies.

24. A structural assembly as claimed in claim 21, wherein said anchor members are each held in wedging relationship with a pair of said elongate members.

* * * * *